US009108831B2

(12) United States Patent
Beji

(10) Patent No.: US 9,108,831 B2
(45) Date of Patent: Aug. 18, 2015

(54) ORDER PICKER

(75) Inventor: Slaheddine Beji, Vienne (FR)

(73) Assignee: HAULOTTE GROUP, L'Horme (FR)

( * ) Notice: Subject to any disclaimer, the term of this patent is extended or adjusted under 35 U.S.C. 154(b) by 477 days.

(21) Appl. No.: 13/012,158

(22) Filed: Jan. 24, 2011

(65) Prior Publication Data

US 2011/0180349 A1 Jul. 28, 2011

(30) Foreign Application Priority Data

Jan. 26, 2010 (FR) ..... 10 50500

(51) Int. Cl.
*B66F 11/04* (2006.01)

(52) U.S. Cl.
CPC ..... *B66F 11/04* (2013.01)

(58) Field of Classification Search
CPC ..... B66F 11/04; A01D 46/20; E04G 1/20
USPC ..... 182/148, 69.4, 69.6
See application file for complete search history.

(56) References Cited

U.S. PATENT DOCUMENTS

| | | | | | |
|---|---|---|---|---|---|
| 159,571 | A * | 2/1875 | Schmid | 182/62.5 |
| 3,236,329 | A * | 2/1966 | Price | 182/14 |
| 3,282,374 | A * | 11/1966 | Allen et al. | 182/12 |
| 3,596,735 | A * | 8/1971 | Denier et al. | 182/16 |
| 4,157,129 | A * | 6/1979 | Christopher | 182/82 |
| 4,295,431 | A * | 10/1981 | Stavlo | 108/55.1 |
| 4,436,183 | A * | 3/1984 | Laurich-Trost | 187/224 |
| 5,203,425 | A * | 4/1993 | Wehmeyer | 182/19 |
| 5,644,992 | A * | 7/1997 | Clive-Smith | 108/55.1 |
| 5,992,572 | A * | 11/1999 | Gilliland et al. | 187/231 |
| 6,050,365 | A * | 4/2000 | Newlin | 182/69.5 |
| 6,471,004 | B2 * | 10/2002 | Stringer et al. | 182/148 |
| 2002/0074186 | A1 * | 6/2002 | Baldas et al. | 182/69.6 |
| 2006/0245893 | A1 * | 11/2006 | Schottke | 414/632 |
| 2007/0074935 | A1 * | 4/2007 | Zahn | 182/141 |
| 2008/0105498 | A1 * | 5/2008 | Perkins | 187/269 |
| 2009/0071751 | A1 * | 3/2009 | Schmidt et al. | 182/63.1 |
| 2009/0078502 | A1 * | 3/2009 | Knurr | 182/13 |
| 2012/0042458 | A1 * | 2/2012 | Bennett et al. | 14/71.3 |
| 2012/0186908 | A1 * | 7/2012 | Crook et al. | 182/69.5 |

FOREIGN PATENT DOCUMENTS

| | | | | |
|---|---|---|---|---|
| EP | 1 009 709 | A1 | 6/2000 | |
| FR | 2909084 | A1 * | 5/2008 | B66F 11/04 |
| JP | 410067493 | A | 3/1998 | |
| WO | 99 13184 | A1 | 3/1999 | |

* cited by examiner

*Primary Examiner* — Alvin Chin-Shue
*Assistant Examiner* — Candace L Bradford
(74) *Attorney, Agent, or Firm* — Dowell & Dowell, P.C.

(57) ABSTRACT

An order picker for preparing orders that includes a motor-driven mobile chassis, a platform, an elevator for elevating the platform relative to the chassis, a load support tray for supporting loads, and a safety guardrail around the periphery of the platform. The tray is secured to a movable portion of the guardrail that moves in translation along a longitudinal axis of the order picker between a first position, in which the movable portion extends to a first greater distance from a front edge of a deck of the platform, and a second position, at a second lesser distance from the front edge and wherein the tray is movable between a first position extending horizontally above the deck when the moving portion is in the first position thereof and a second position, in which the tray is folded into a substantially vertical position when the moving portion is in the second position thereof.

10 Claims, 7 Drawing Sheets

ORDER PICKER

BACKGROUND OF THE INVENTION

1. Field of the Invention

The present invention relates to an order picker for preparing orders, which order picker comprises a motor-driven mobile chassis, a platform, elevator means for elevating the platform relative to the chassis, a load support tray, and a guardrail.

2. Brief Description of the Related Art

In places where goods are stored, such as warehouses or superstores, it is common to use motor-driven order pickers mainly for transporting goods from a place of storage to a place of packaging or of delivery. Such a picker is equipped with a transporter tray that is designed for handling goods, and that is optionally of adjustable height, and such a picker is generally reserved for use by one person. Such order pickers must be compact in order to fit between the shelving and pass other order pickers going the other way. Such an order picker can also have an elevating platform making it possible to access goods stored in vertical storage spaces.

In order to perform maintenance or installation at heights, it is common to use a vehicle having an elevator platform on which two people can stand and work together.

No vehicle exists that combines the two above-mentioned uses, namely both preparing orders and also working at heights, making it possible to accommodate one person or two people, depending on the desired use, under optimum safety conditions and while preserving compactness compatible with traveling between shelving or inside an industrial warehouse.

SUMMARY OF THE INVENTION

An object of the invention is to remedy those drawbacks by providing a novel order picker having a platform that offers space adaptable to various uses, by one person or by two people.

To this end, the invention provides an order picker for preparing orders, which order picker comprises a motor-driven mobile chassis, a platform, elevator means for elevating the platform relative to the chassis, a load support tray for supporting loads in the vicinity of the platform, and a safety guardrail around the periphery of the platform. Said order picker is characterized in that the tray is secured to a portion of the guardrail that is movable in translation, along a longitudinal axis of the order picker, between a first position, in which the moving portion extends at a first distance from a front edge of the deck of the platform, and a second position, in which the moving portion extends at a second distance from the front edge, in that the first distance is strictly greater than the second distance, in that the tray is movable between a first position, in which it extends horizontally above the deck of the platform, and a second position, in which it is folded away in a substantially vertical position, in that the tray is in its first position when the moving portion is in its first position, and in that the tray is in its second position when the moving portion is in its second position.

By means of the invention, the order picker can be adapted to use by one person or by two people, the safety of the person or of the people being ensured in both configurations. In addition, the compactness of the order picker is preserved in both configurations by means of the possibility of folding the tray away in the configuration in which two people are standing on the platform, making it possible to avoid bulky portions of the order picker extending beyond the platform. Such protruding portions could hinder the possibilities for movement of the order picker in a storage place, and could adversely affect the balance of the order picker.

In advantageous but non-essential aspects of the invention, such an order picker may incorporate one or more of the following characteristics, taken individually or in any technically feasible combination:

- The first distance has a value lying in the range ¼ of the longitudinal dimension of the platform to ⅔ of said longitudinal dimension of the platform, while the second distance has a value strictly less than ¼ of the longitudinal dimension of the platform.
- The moving portion of the guardrail includes a front frame on which the tray is mounted, while said front frame is connected to the stationary portion of the guardrail by hinged levers that are movable between a first position corresponding to the first position of the moving portion and a second position corresponding to the second position of the moving portion.
- A first end of each lever is hinged to the front frame, while the second end of each lever is hinged to the stationary portion of the guardrail and is adapted to slide, in a substantially vertical direction, in a runner that is secured to the stationary portion of the guardrail.
- Each runner is provided with a locking notch that is adapted to receive the second end of a lever and to prevent said lever from sliding in said runner.
- The tray is mounted to pivot relative to the front frame about a horizontal axis of the order picker.
- It further comprises at least one retractable extension adapted to provide an additional transport surface extending beyond the platform.
- The or each retractable extension is adapted to be received, in a retracted configuration, in a recess situated under the deck of the platform.
- The or each retractable extension is provided with rollers having their longitudinal axes perpendicular to the longitudinal axis and to a vertical axis of the order picker.
- The height of the tray relative to the deck of the platform is adjustable.

BRIEF DESCRIPTION OF THE DRAWINGS

The invention can be better understood and other advantages of the invention appear more clearly from the following description of an embodiment of an order picker of the invention, given by way of example and with reference to the accompanying drawings, in which.

DESCRIPTION OF THE PREFERRED EMBODIMENT

Figure 1:
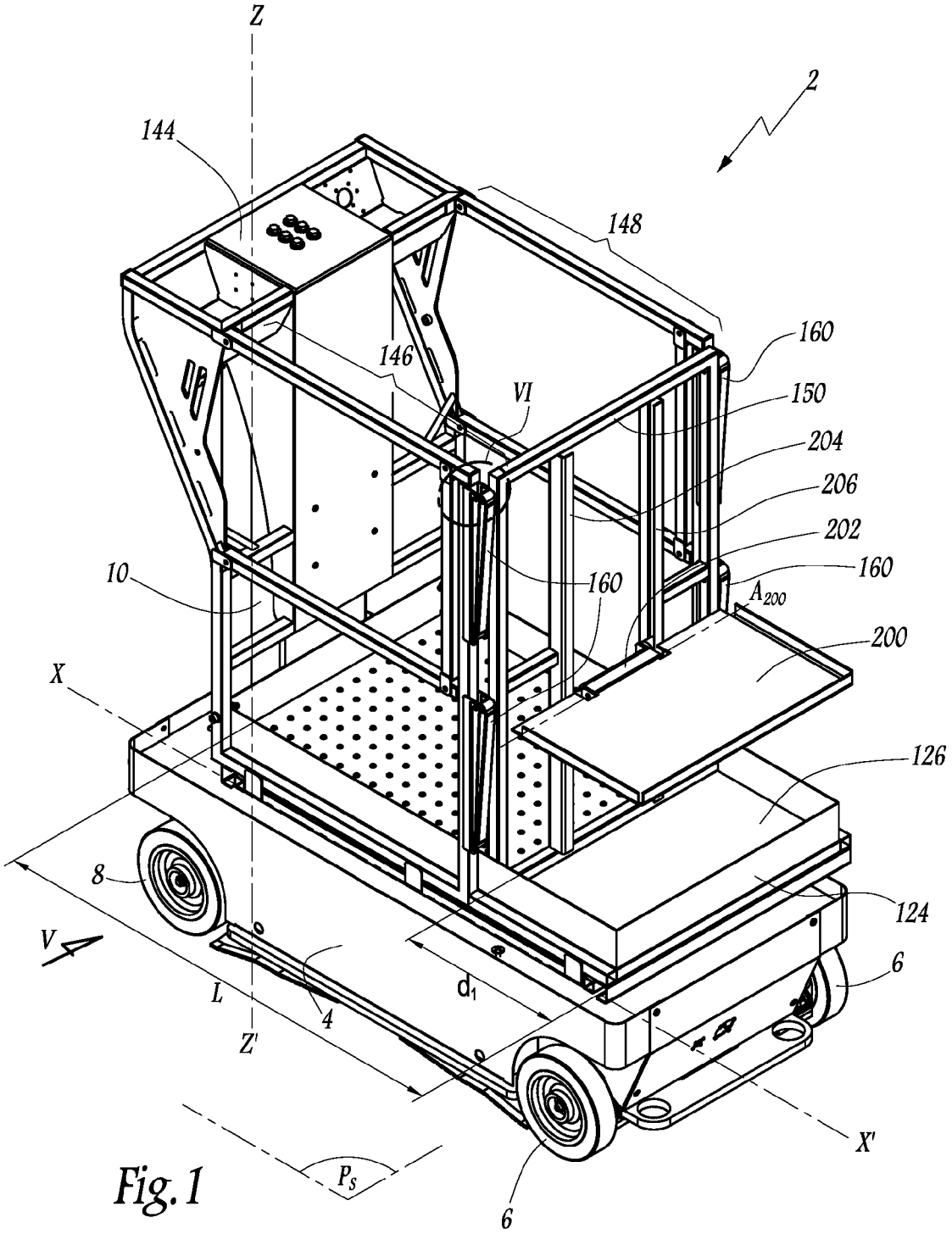
FIG. 1 is a perspective view of a an order picker of the invention, in a configuration in which the tray extends above a portion of the deck of the platform.

The order picker 2 shown in the figures includes a chassis 4 equipped with a front set of wheels 6 and with a rear set of wheels 8. The picker 2 is suitable for moving by rolling on a plane floor represented by a plane $P_S$. A longitudinal axis of the chassis 4 is referenced X-X'. An axis perpendicular to the axis X-X' and parallel to the plane $P_S$ is referenced Y-Y'.

The chassis 4 is equipped with a motor (not shown) making it possible to move the picker 2. The drive is transmitted to the front set of wheels 6. The order picker 2 has a steering transmission to the rear wheels 8 that is not shown in the drawings.

On a top face 42, the chassis 4 has a telescopic mast 10 for elevating a platform 12 that is secured to its top end. The mast 10 makes it possible selectively to elevate the platform to a working height of 6 meters, and to allow one person or two people to perform work, in particular on ceilings or on shelving at heights.

The telescopic mast 10 is made up of three stage segments $\mathbf{10}_1$, $\mathbf{10}_2$, $\mathbf{10}_3$ along a longitudinal axis Z-Z' perpendicular to the plane $P_S$, between the face 42 and the platform 12 secured to the segment $\mathbf{10}_3$. The segments $\mathbf{10}_2$ and $\mathbf{10}_3$ are adapted to slide in the segment $\mathbf{10}_1$, in a manner such that only the segment $\mathbf{10}_1$ is visible when the platform is in the low position.

The platform 12 has a deck 122 from which a guardrail 14 extends upwards. In the vicinity of the front set of wheels 6, the deck 122 has a front edge 124. The guardrail 14 has a rear frame 142 secured to a control station 144 that forms a junction between the segment $\mathbf{10}_3$ of the mast 10 and the platform 12, and that makes it possible, in addition to controlling the elevation of the platform 12, to control movement of the control picker 2, and to control other features. The guardrail 14 also has two side frames 146 and 148 extending parallel to the axis X-X' and secured to the rear frame 142. Finally, the guardrail 14 includes a front frame 150 secured to the side frames 146 and 148.

Each of the four frames 142, 146, 148, and 150 is made up of a plurality of section-member segments connected together by welding or by bolting.

Each of the side frames 146 and 148 is formed in two portions, so that said side frames have two first portions 152 and 154 secured to the rear frame 142, and two retractable second portions 156 and 158. Each of the first portions 152 and 154 has a side access enabling the people using the order picker 2 to climb aboard the platform, and to alight from it. Each of the first portions 152 and 154 has two bars 153 and 153' that are substantially parallel to each other and to the axis X-X', and that are hinged at one end to the rear frame 142 in such a manner as to pivot about respective ones of two axes $A_{153}$ and $A'_{153}$ that are parallel to the axis Y-Y'.

The two bars 153 and 153' are interconnected, in the vicinity of their ends opposite from the rear frame 142, by a transverse bar 155 hinged to each of the two bars 153 and 153'. Access to and exit from the platform 12 is by raising the bars 153 and 153' of one of the side frames 146 or 148.

The front frame 150 is connected to the first portions 152 and 154 via a plurality of levers 160, each of which is hinged at one of its ends to the front frame 150 about an axis $A_{160}$ perpendicular to the axis X-X' and parallel to the plane $P_S$.

At its other end 162, in the vicinity of the first portions 152 and 154, each lever 160 has two transverse pins 164 extending parallel to the axis Y-Y'. These pins 164 are received in mutually parallel runners 166 fastened to the first portions 152 and 154. In practice, the runners 166 are plane parts, each of which is provided with an elongate slot 168 in which the pins 164 move. Each slot 168 is provided parallel to the axis Z-Z'. At its top end 70, each slot 168 is provided with a locking notch 172 offset relative to the axis of said slot 168, and having an abutment 174 for stopping the pins 164.

Figure 3:
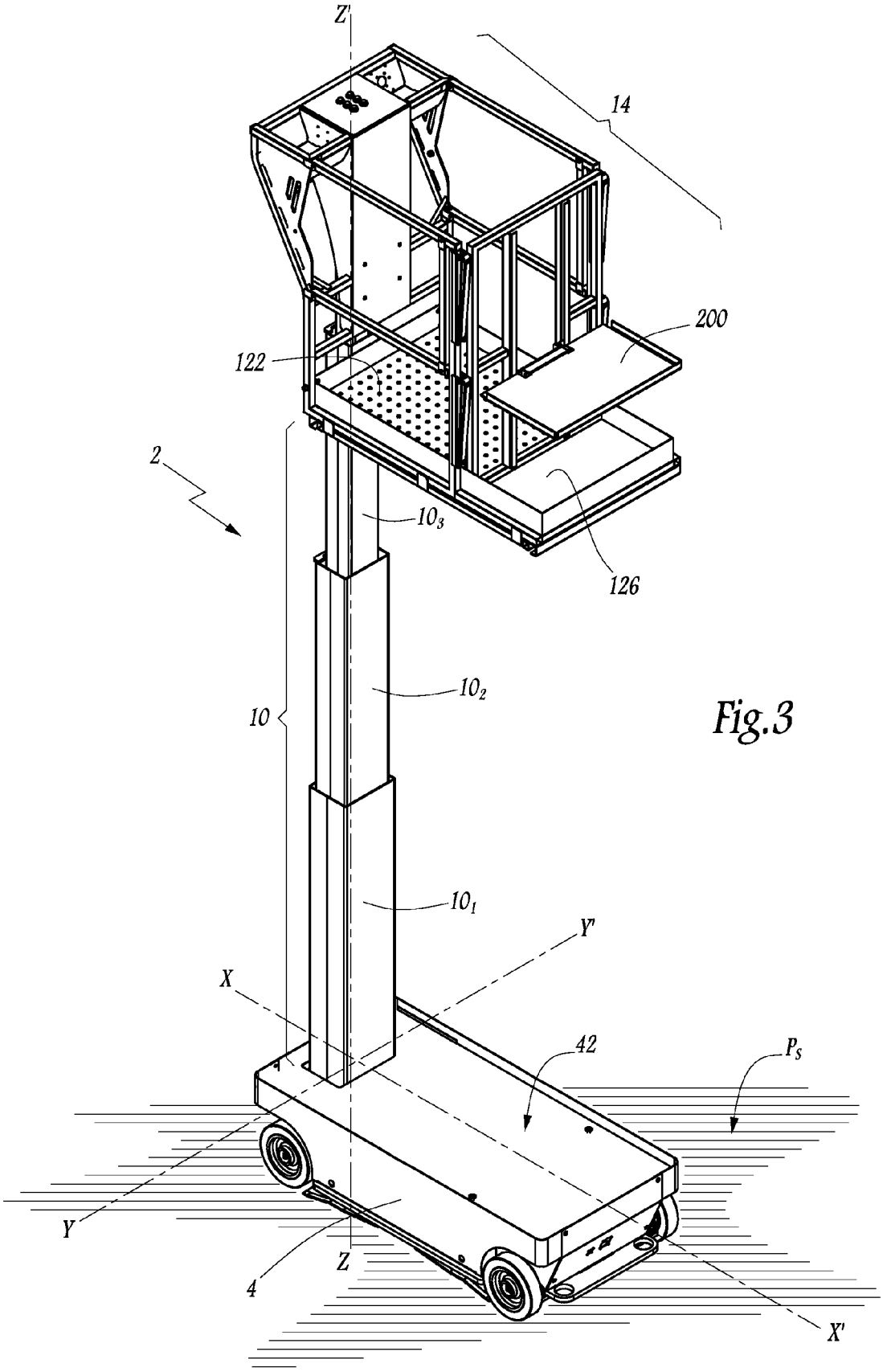
FIG. 3 is a view of the order picker in a configuration comparable to FIG. 1 and in which the platform is elevated relative to the chassis.

The front frame 150 is provided with a load transporter tray 200 extending parallel to the plane $P_S$ on the front of the front frame 150 in the configurations of FIGS. 1 and 3. The tray 200 is pivotally mounted to pivot about an axis $A_{200}$ perpendicular to the axis X-X' and parallel to the plane $P_S$ on a support 202 secured to the front frame 150. The support 202 is mounted in two uprights 204 and 206 of the front frame 150, in a manner such that it can slide parallel to the axis Z-Z'. In this way, the height of the tray 200 relative to the deck 122 of the platform 12 is adjustable. This adjustment may be achieved in motor-driven manner and in a manner controlled by the control station 144, but it may also be achieved manually by means of staged fastening devices not shown in the drawings, such as racks.

The order picker 2 is reserved for indoor use, in particular for transporting goods from one point to another in a storage or delivery building. To this end, it may be used in a first configuration, in which only one person stands on the platform. In this first configuration, the tray 200 is deployed in the horizontal position, in order to enable the operator to place on it goods taken from any given place, in particular from shelving. In this first configuration, in order to prevent the tray 200 from projecting beyond the platform 12, the front frame 150 is placed in a position in which it is set back from the front edge 124, as shown in FIGS. 1, 3, 5, and 6, in which position the portions 156 and 158 of the guardrail 14 are retracted. In this position, the front frame 150 is situated at a distance $d_1$ from the front edge 124, where $d_1$ lies in the range ¼ of the longitudinal dimension L of the platform 12, to ⅔ of said longitudinal dimension, where said longitudinal dimension L is the length of the platform 12 parallel to the axis X-X'. For this purpose, the ends 162 of the levers 160 are placed in the slots 168 towards the deck 122 of the platform 12, in order to enable the front frame 150 to be relatively close to the rear frame 142. The space saved in this way allows the tray 200 to be deployed in a manner such that said tray does not project beyond the platform 12. This makes it possible to preserve the compactness of the order picker 2 with a view to it moving in a place in which goods are stored and in which other order pickers can travel. This configuration of use represents the most common use of the order picker 2.

In the configuration shown in FIGS. 1, 3, 5, and 6, a space 126 for storing the goods is available on the portion of the deck 122. This space 126, which is situated between the front edge 124 and the front frame 150, is of height limited by the tray 200, and it can serve to store goods of small size.

If necessary, the mast 10 of the order picker 2 can be deployed, by means of actuators (not shown), for the purpose of retrieving goods situated on shelving at heights, as can apply in warehouses for storing orders.

Figure 2:
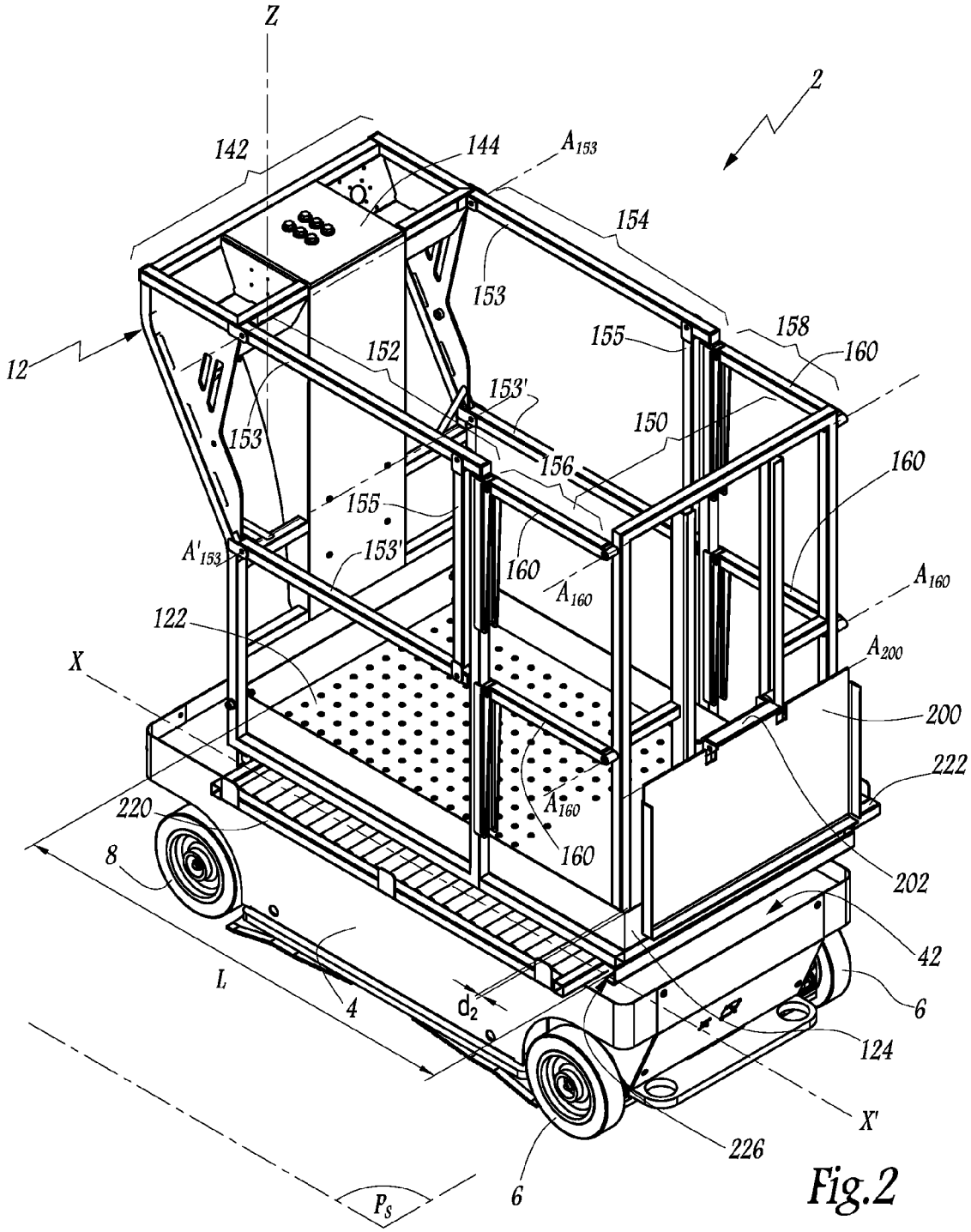
FIG. 2 is a view analogous to FIG. 1, in a configuration in which the tray is folded away, and a moving portion of the guardrail extends in the vicinity of an edge of the deck of the platform.
Figure 4:
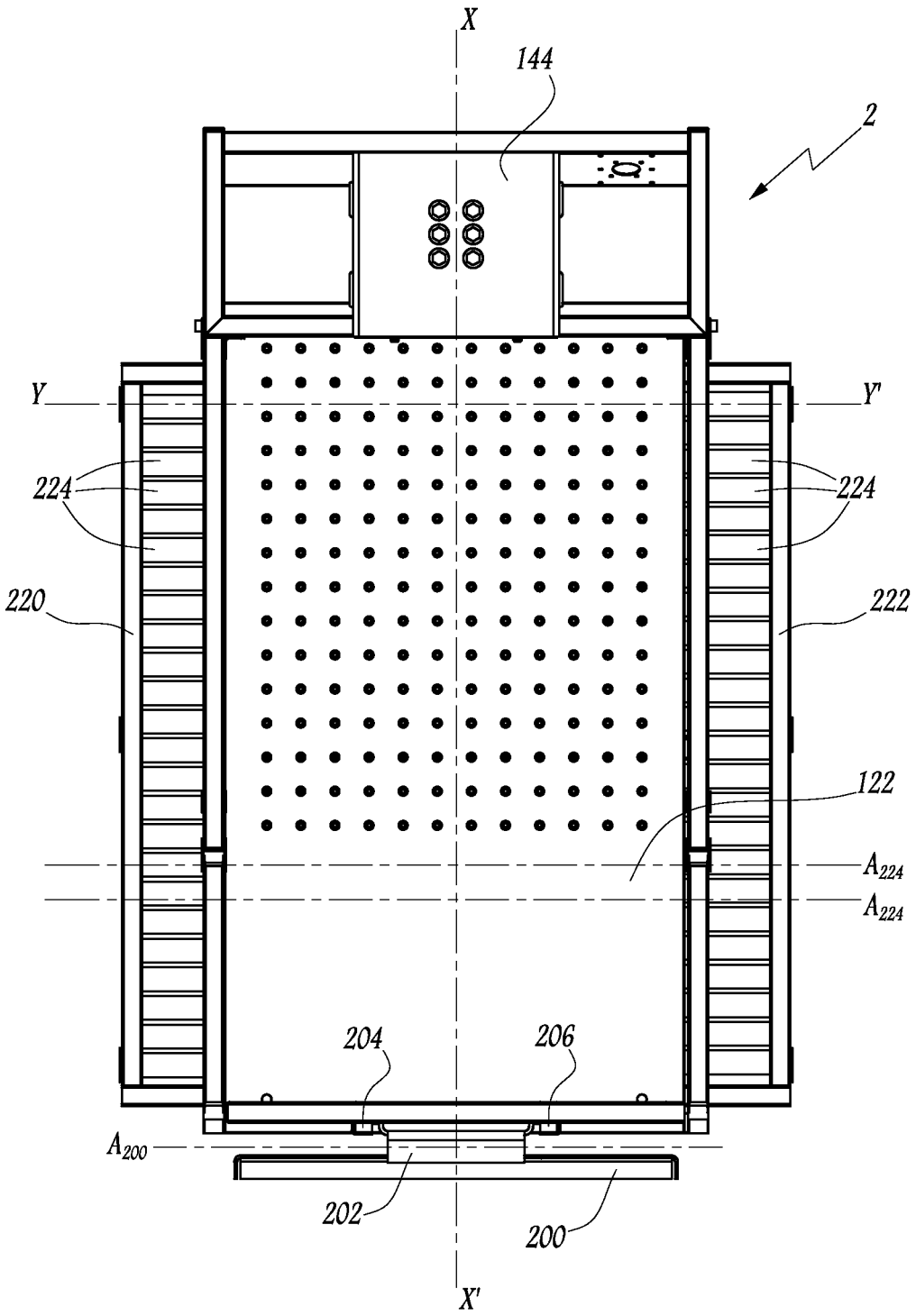
FIG. 4 is a plan view of the order picker in the configuration of FIG. 2.
Figure 5:
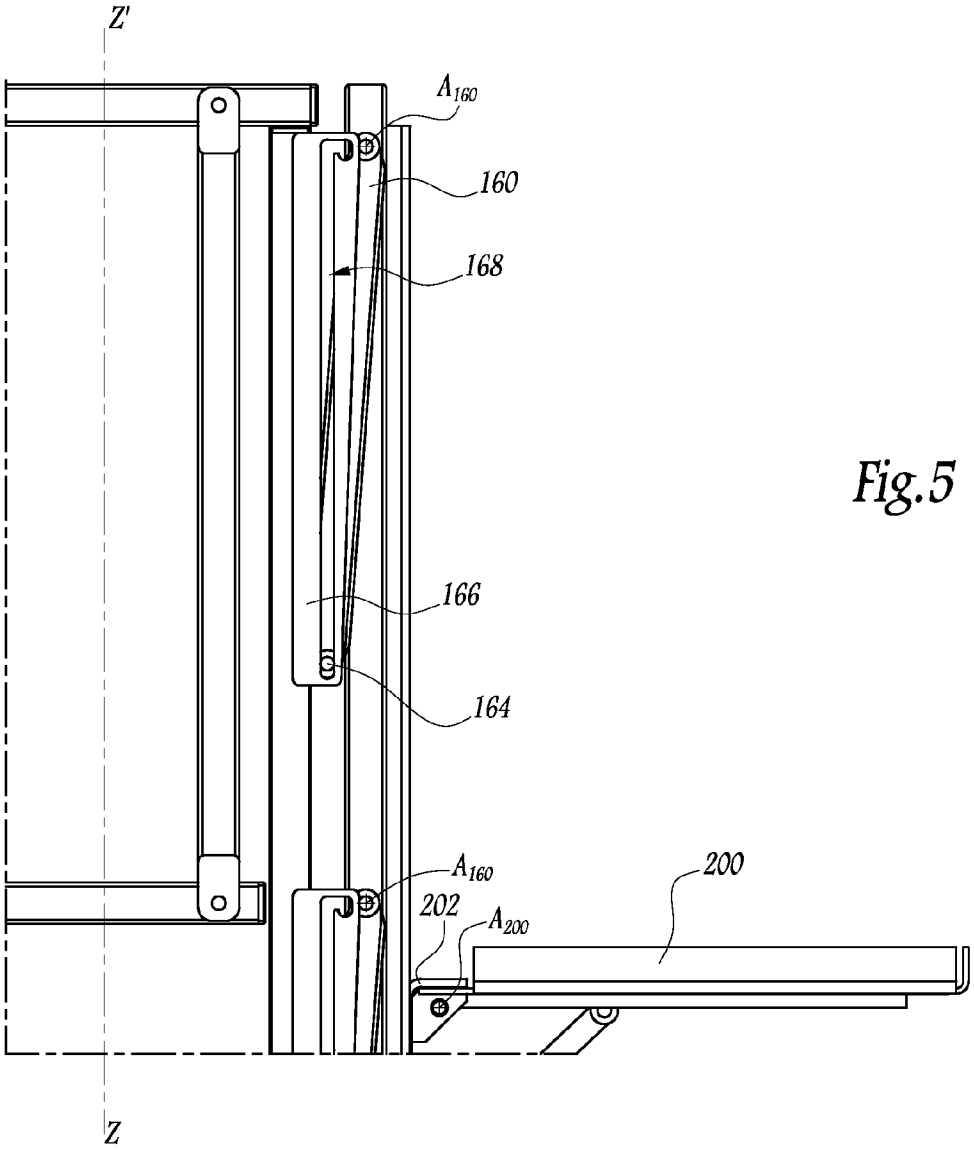
FIG. 5 is a view seen looking along arrow V of FIG. 1 and on a larger scale showing a portion of the order picker in the configuration of FIG. 1.
Figure 6:
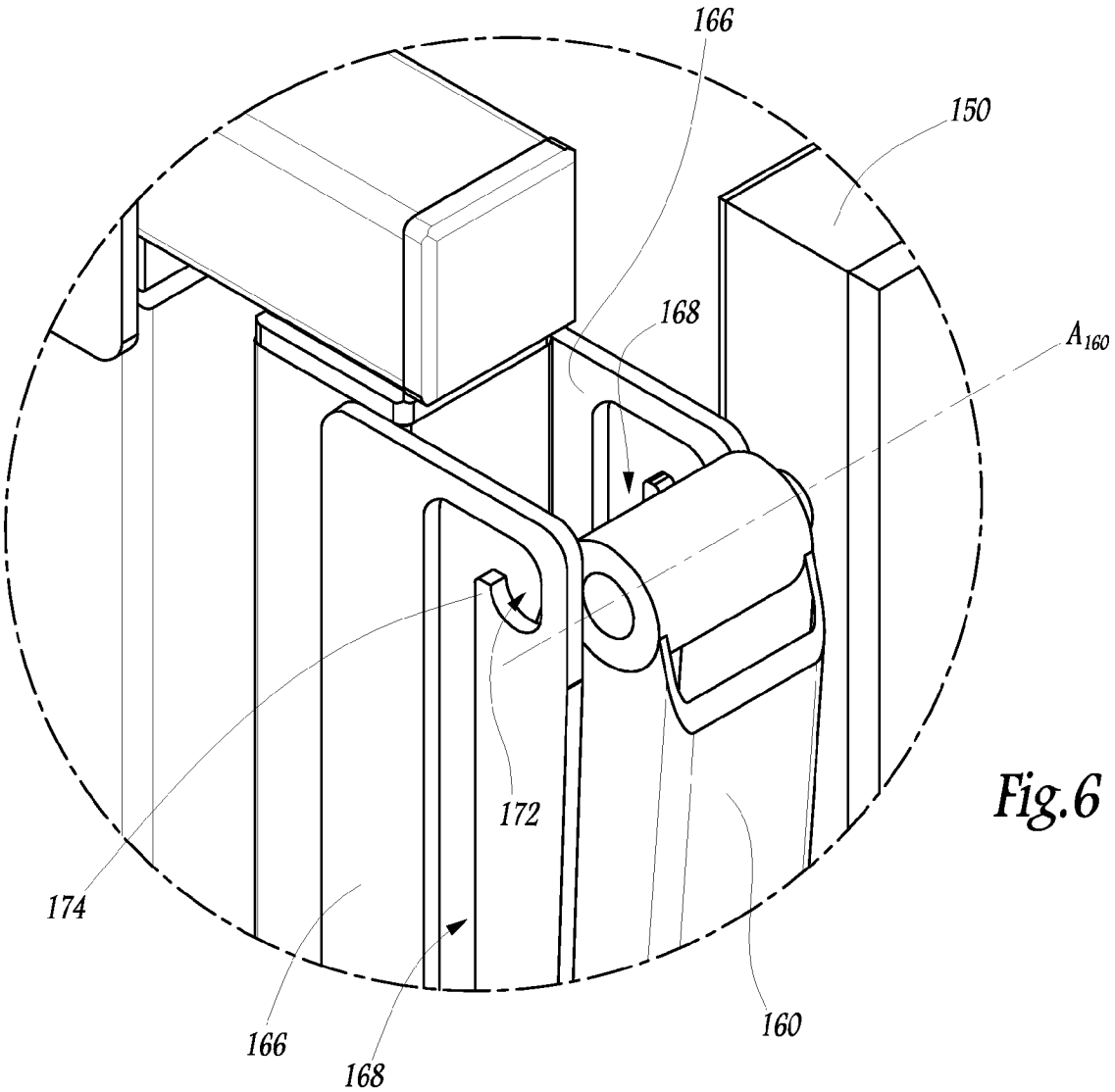
FIG. 6 is a view of the detail VI of FIG. 1.
Figure 7:
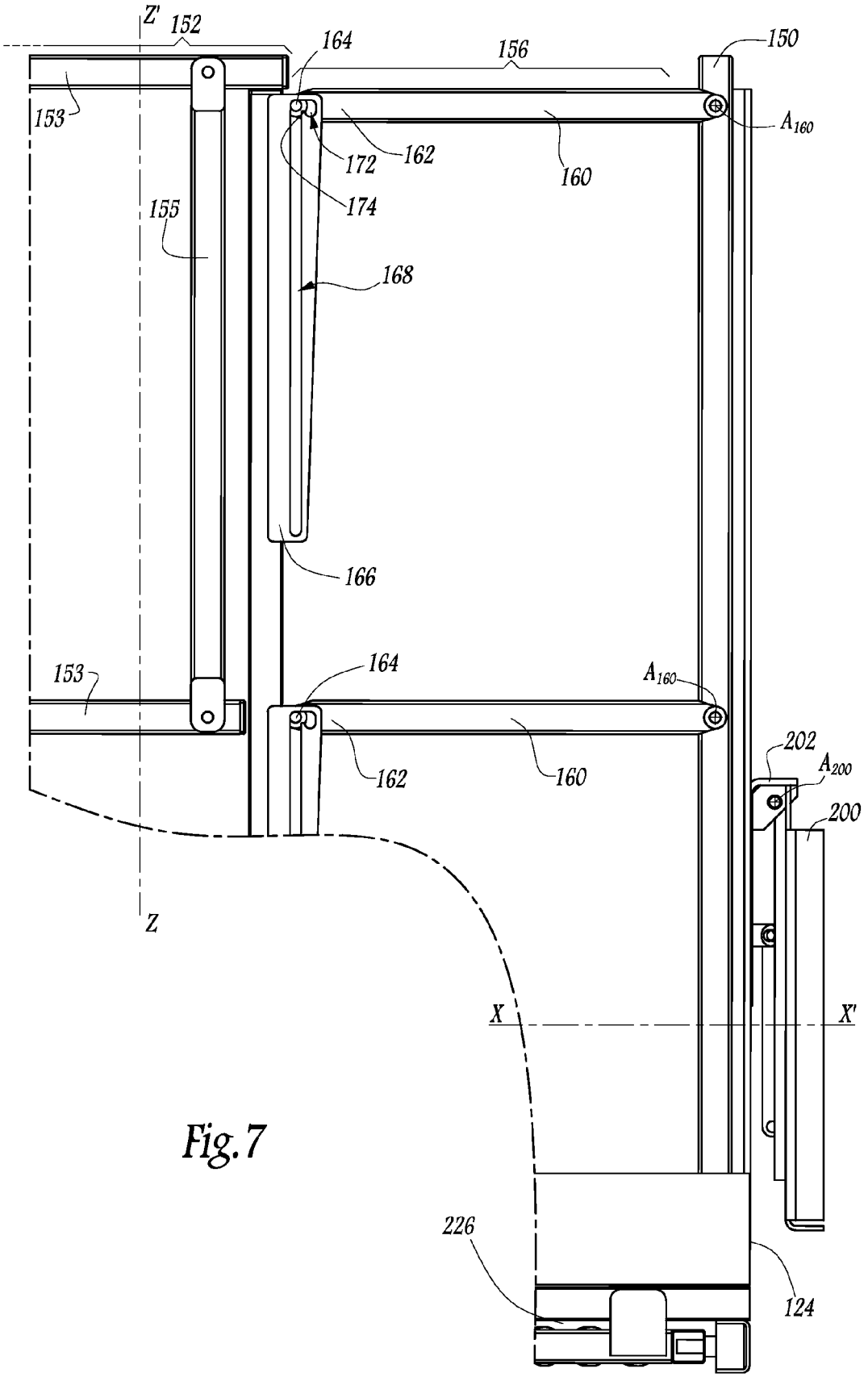
FIG. 7 is a view analogous to FIG. 5, in the FIG. 2 configuration.

The order picker 2 may also be used in a second configuration shown in FIGS. 2, 4, and 7, in which two people can stand on the platform 12. Such a configuration can be necessary, for example, for loading voluminous articles, or for doing maintenance work at heights. Such work can be wiring work or work for changing electrical lighting or bulbs in ceiling lights.

In this configuration, the tray 200 is folded away, in a vertical position, against the front frame 150. In order to extend the available space in the platform 12, the front frame 150 is advanced to the vicinity of the front edge 124 of the deck 122, at a distance $d_2$ that is strictly less than ¼ of the longitudinal dimension L of the platform 12. For this purpose, the ends 162 of the levers 160 are moved towards the top ends 170 of the slots 68. Since the length of the levers 160 is substantially equal to the dimension along the axis X-X' of the tray 200 in the deployed position, this effect of the levers 160 moving in this way is to increase the area available for the occupants of the order picker 2 by an area substantially equal to the area of the tray 200. In order to lock the position in the vicinity of the front edge 124, the pins 164 provided at the ends 162 of the levers 160 are engaged in the notches 172 in the top ends 170 of the runners 166. The abutments 174 then prevent the pins 164 from engaging in the slots 168. Thus, in this configuration, two people can stand on the platform 12 and do work at heights entirely safely. However, the tray 200 cannot be used in this configuration, because opening it might unbalance the order picker 2. If the tray 200 is deployed while two people are standing on the platform 12, the position of the tray is detected by sensors and movement of the order picker 2 is rendered impossible.

The operations necessary for changing the configuration of the order picker 2 may be performed manually, but they may also be controlled electrically from the control station 144, and involve actuators acting on the front frame 150 for moving it between the two above-mentioned configurations. It is possible to make provision for configuration change to be fully automated for the order picker 2, simultaneously involving changing the position of the front frame 150 and tipping the tray 200. Such tipping may also be achieved automatically by a system of cams (not shown), while the position of the front frame 150 is being changed manually.

In order to provide larger load carriage capacity without excessively upsetting the balance of the order picker 2, two side stowage spaces are provided at the same level as the deck 122. Two extensions 220 and 222, each of which is slidably received in a respective recess 226 in the platform 12 can be used. The extensions 220 and 222 can be received entirely under the floor 122, inside the recesses 226, in a retracted position. In the deployed position shown in FIGS. 2 and 4, said extensions 220 and 222 offer transport surfaces of length equal to the longitudinal dimension of the platform, and of width not exceeding 150 mm, and preferably 120 mm. The extensions 220 and 222 can be deployed independently from each other. They are designed to receive elongate goods such as table tops, or flat packs of large size, that can be leant up against one of the first portions 152 and 154 of the guardrail. In order to facilitate handling and transporting such goods, the extensions 220 and 222 are provided with adjacent rollers 224 that rotate about axes $A_{224}$ perpendicular to the axes X-X' and Z-Z'.

The invention claimed is:

1. An order picker for preparing orders comprising a motor-driven mobile chassis, an elevator mounted to the chassis for elevating a platform having a deck for supporting an operator relative to the chassis, the chassis having opposite ends, the deck being of a fixed overall surface area that extends between, but not beyond, opposite ends of the platform, a safety guardrail mounted around a periphery of the platform, the safety guardrail including a movable portion that is movable in translation relative to a fixed portion of the safety guardrail and to the deck of the platform so as to adjust an area of the deck for supporting an operator between a first deck area for supporting a single operator and a second deck area which is larger than the first area, a tray secured to the movable portion of the guardrail that is movable in translation relative to the platform, along a longitudinal axis of the chassis, between a first position, in which the movable portion of the guardrail is spaced at a first distance from a front edge of the deck so as to define the first area of the deck, and a second position, in which the movable portion of the guardrail is at a second distance closer to the front edge of the deck so as to define the second area of the deck, the tray being movable between a horizontal load supporting position, in which the tray extends horizontally to and above the deck of the platform without extending beyond the platform to thereby preserve the compactness of the order picker, and a vertical position, in which the tray is moved into a substantially vertical position so as to be generally perpendicularly oriented relative to the deck so that the tray cannot be used to support a load outward from one of the opposite ends of the chassis, and wherein the tray is in the horizontal position thereof when the movable portion of the guardrail is in the first position thereof, and the tray is in the vertical position thereof when the movable portion of the guardrail is in second position thereof.

2. The order picker according to claim 1, wherein the first distance has a value lying in a range of between one-quarter to two-thirds of a longitudinal dimension of the platform, and wherein the second distance has a value less than one-quarter of the longitudinal dimension of the platform.

3. The order picker according to claim 1, wherein the movable portion of the guardrail includes a front frame on which the tray is mounted, and the front frame being connected to a stationary portion of the guardrail by hinged levers that are movable between a first position corresponding to the first position of the movable portion of the guardrail and a second position corresponding to the second position of the movable portion of the guardrail.

4. The order picker according to claim 3, wherein a first end of each lever is hinged to the front frame, and wherein a second end of each lever is hinged to the stationary portion of the guardrail and slides, in a substantially vertical direction, in a runner that is secured to the stationary portion of the guardrail.

5. The order picker according to claim 4, wherein each runner includes a locking notch to receive the second end of a lever to prevent the lever from sliding in the runner.

6. The order picker according to claim 3, wherein the tray is mounted to pivot relative to the front frame about a horizontal axis of the order picker.

7. The order picker according to claim 1, including at least one retractable extension providing an additional transport surface which may be extended laterally outwardly relative to the longitudinal axis of the chassis and from under the deck of the platform.

8. The order picker according to claim 7, wherein the at least one retractable extension is received, when in a retracted configuration relative to the platform, in a recess situated under the deck of the platform.

9. The order picker according to claim 7, wherein the at least one retractable extension is provided with rollers having longitudinal axes perpendicular to the longitudinal axis of the chassis and to a vertical axis of the chassis.

10. The order picker according to claim 1, wherein the tray is vertically adjustable relative to the deck of the platform.

* * * * *